US006110025A

United States Patent [19]

Williams et al.

[11] Patent Number: 6,110,025

[45] Date of Patent: Aug. 29, 2000

[54] CONTAINMENT RING FOR SUBSTRATE CARRIER APPARATUS

[75] Inventors: Roger O. Williams; James D. Buhler, both of Fremont, Calif.

[73] Assignee: Obsidian, Inc., Fremont, Calif.

[21] Appl. No.: 08/853,103

[22] Filed: May 7, 1997

[51] Int. Cl.[7] ..... B24B 5/00; B24B 29/00

[52] U.S. Cl. ..... 451/286; 451/287; 451/288; 451/397; 451/398

[58] Field of Search ..... 451/41, 285, 287, 451/288, 289, 386, 387, 397, 398, 259, 268, 269

[56] References Cited

U.S. PATENT DOCUMENTS

| | | | |
|---|---|---|---|
| 3,518,798 | 7/1970 | Boettcher . | |
| 4,194,324 | 3/1980 | Bonora et al. . | |
| 4,270,314 | 6/1981 | Cesna . | |
| 4,313,284 | 2/1982 | Walsh . | |
| 4,425,038 | 1/1984 | La Fiandra et al. . | |
| 4,811,522 | 3/1989 | Gill, Jr. . | |
| 4,954,142 | 9/1990 | Carr et al. . | |
| 5,036,630 | 8/1991 | Kaanta et al. . | |
| 5,081,795 | 1/1992 | Tanaka et al. . | |
| 5,193,316 | 3/1993 | Olmstead . | |
| 5,205,082 | 4/1993 | Shendon et al. . | |
| 5,230,184 | 7/1993 | Bukhman . | |
| 5,232,875 | 8/1993 | Tuttle et al. . | |
| 5,234,867 | 8/1993 | Schultz et al. . | |
| 5,297,361 | 3/1994 | Baldy et al. . | |
| 5,329,732 | 7/1994 | Karlsrud et al. . | |
| 5,335,453 | 8/1994 | Baldy et al. . | |
| 5,377,451 | 1/1995 | Leoni et al. . | |
| 5,384,986 | 1/1995 | Hirose et al. . | |
| 5,398,459 | 3/1995 | Okumura et al. . | |
| 5,423,558 | 6/1995 | Koeth et al. . | |
| 5,423,716 | 6/1995 | Strasbaugh . | |
| 5,441,444 | 8/1995 | Nakajima . | |
| 5,476,548 | 12/1995 | Lei et al. . | |
| 5,487,697 | 1/1996 | Jensen . | |
| 5,498,196 | 3/1996 | Karlsrud et al. . | |
| 5,498,199 | 3/1996 | Karlsrud et al. . | |
| 5,527,209 | 6/1996 | Volodarsky et al. . | |
| 5,533,924 | 7/1996 | Stroupe et al. . | |
| 5,538,465 | 7/1996 | Netsu et al. | 451/397 |
| 5,542,874 | 8/1996 | Chikaki . | |
| 5,547,417 | 8/1996 | Breivogel et al. . | |
| 5,554,064 | 9/1996 | Breivogel et al. . | |
| 5,562,529 | 10/1996 | Kishii et al. . | |
| 5,564,965 | 10/1996 | Tanaka et al. . | |
| 5,569,062 | 10/1996 | Karlsrud . | |
| 5,571,044 | 11/1996 | Bolandi et al. . | |
| 5,582,534 | 12/1996 | Shendon et al. . | |
| 5,584,746 | 12/1996 | Tanaka et al. | 451/41 |
| 5,584,751 | 12/1996 | Kobayashi et al. | 451/398 |
| 5,588,902 | 12/1996 | Tominaga et al. . | |
| 5,593,344 | 1/1997 | Weldon et al. . | |
| 5,593,537 | 1/1997 | Cote et al. . | |
| 5,595,529 | 1/1997 | Cesna et al. . | |
| 5,597,346 | 1/1997 | Hempel, Jr. . | |
| 5,643,061 | 7/1997 | Jackson et al. . | |
| 5,645,474 | 7/1997 | Kubo et al. . | |
| 5,733,182 | 3/1998 | Muramatsu et al. | 451/288 |
| 5,738,568 | 4/1998 | Jurjevic et al. | 451/288 |
| 5,738,574 | 4/1998 | Tolles et al. | 451/288 |

FOREIGN PATENT DOCUMENTS

| | | |
|---|---|---|
| 0770455 A1 | 5/1997 | European Pat. Off. . |
| 0774323 A2 | 5/1997 | European Pat. Off. . |
| 63-062668 | 3/1988 | Japan . |
| 9-225821 | 2/1997 | Japan . |

*Primary Examiner*—David A. Scherbel
*Assistant Examiner*—Derris Holt Banks
*Attorney, Agent, or Firm*—Morrison & Foerster

[57] ABSTRACT

This invention involves a containment ring that may be used in conjunction with a substrate carrier used for polishing a substrate to give the substrate a smooth and planar surface. The containment ring is generally constructed such that it tilts independently of the substrate carrier platen that supports the substrate during polishing. The containment ring is constructed with a surface that supports a small perimeter portion of the back side of the substrate during polishing and has an enclosed area sufficient to allow the substrate to precess.

28 Claims, 10 Drawing Sheets

CONTAINMENT RING FOR SUBSTRATE CARRIER APPARATUS

FIELD OF THE INVENTION

This invention generally relates to a polishing apparatus. More specifically this invention relates to a substrate carrier used for polishing a substrate to give the substrate a smooth and planar surface. A containment ring is provided to improve the planarity of the substrate surface during polishing.

BACKGROUND OF THE INVENTION

The manufacture of integrated circuits generally involves an elaborate system of fabricating semiconductor devices on a substrate and connecting the devices together. The devices are connected by a process generally referred to as metalization, in which connecting lines of metal, often aluminum, are applied by vacuum deposition or other suitable process.

The performance level of semiconductor devices employing a conventional single metal layer connecting the devices is becoming inadequate. Modern, high performance devices utilize multilevel metal interconnections. Multilevel connections may be constructed by depositing a dielectric or insulating layer over a first metal layer, etching via holes throughout the dielectric layer, and then depositing a second metal layer which fills the via holes to connect with the first metal layer. These devices offer higher device density and shortened interconnection lengths between the devices.

Since each of these metal and dielectric layers has an appreciable thickness, the substrate is left with non-planar topography as the various layers are patterned on top of one another. This type of non-planarity is often unacceptable in high density devices because the depth of field of the lithographic equipment that is used to print the smaller line width circuits on the substrate does not have a depth of focus sufficient to compensate for even small variations in substrate planarity.

In addition to the non-planarity caused by the fabricated device patterns, in-process substrate polishing, or planarization, must account for variations in overall substrate flatness as well. During the fabrication process, for example, the substrates may become bowed or warped.

In-process substrate polishing equipment, therefore, requires the specialized ability to achieve global, uniformly planar substrate surfaces in spite of these topographical substrate defects and variations. Chemical-mechanical polishing has gained wide acceptance as an effective means of achieving the global substrate surface planarity required by advanced devices employing multilayer metalization.

FIG. 1 shows a cross section of a typical prior art chemical-mechanical polishing arrangement. A typical device includes a substrate carrier having a generally circular pressure plate or platen 1 that supports a single substrate 3. Often a carrier film 2 is interposed between the platen 1 and the substrate 3 to partially accommodate substrate thickness variations. The substrate carrier is equipped with means to provide a downward force, urging the substrate 3 against an abrasive pad or strip 5, onto which is fed an abrasive polishing fluid 7. A containment ring 4 generally surrounds the substrate to prevent it from slipping off the platen during polishing. Movement of the substrate relative to the pad, in the presence of the polishing fluid and under pressure from the substrate carrier, imparts a combination of chemical and mechanical forces to the substrate 3, the net effect of which is global planarization of the substrate surface.

A closer look at the chemical-mechanical polishing process reveals that perfected global planarization of a substrate surface is achieved only when there is a uniform removal rate, at every point on the substrate surface. For any given point on the surface of the substrate, the polishing process can be described by Preston's equation:

$$R=K_p \times P \times V,$$

where R is the removal rate; $K_p$ is a function of consumables (abrasive pad roughness and elasticity, surface chemistry and abrasion effects, and contact area), P is the applied pressure between the substrate and the abrasive pad; and V is the relative velocity between the substrate and the abrasive pad.

To obtain optimum results, each of these variables must be held perfectly constant or the effects of their variability must be accommodated for in corrective elements elsewhere in the system. In this regard, the containment ring plays a critical role in controlling the variables which determine the removal rate during polishing.

The constant $K_p$ in Preston's equation, is intended to reflect certain properties relating to the abrasive pad or strip. But many of these properties are not constant, and instead vary to the detriment of optimum planarization. For example the abrasive pad may have localized areas of varying roughness, varying frictional coefficients, varying elasticity (both with respect to compression as the pad is pressed against it but with respect to the amount of stretch encountered in the plane of polish as the pad is pushed across it), and varying amounts of polishing fluid present.

With regard to the applied pressure between the substrate and the abrasive pad, there are many factors that tend to contribute to the formation of localized regions of varying pressure, or pressure gradients, at different locations on the substrate surface. Such contributory factors might include angular misalignment of the substrate to the abrasive pad, frictional forces created by the polishing action that tend to urge the substrate into angular misalignment relative to the abrasive pad, thickness variations in the substrate itself or an uneven platen, and dynamic phenomena resulting from the movement of the substrate against the pad.

One example of such dynamic phenomena is the dynamic wave that is often formed in the abrasive pad at the trailing edge of the substrate as it is polished. Typically, this is evidenced by rings of over polish then under polish on the substrate surface; the substrate being impacted the most at the perimeter and decreasing toward the center as the wave in the pad was dampened out. Often the area of non-uniform polishing around the outer periphery of a substrate is not useable for device formation and is referred to as the edge exclusion zone. To maximize the useful area of a processed substrate, it is highly desirable to minimize the edge exclusion zone.

Devices known in the art have attempted to control some of the troublesome variables that cause non-uniform removal rates during polishing. For example, it is common for the substrate carrier of a device suited for chemical-mechanical polishing, to include some means for automatically aligning the platen and substrate surface with the surface of the polishing pad or strip. Some devices accommodate substrate misalignment by adding a layer of flexible material between the platen and the substrate. The flexible material deforms to allow the angularity of the substrate to match that of the abrasive pad, and at the same time provides support of the substrate during the polishing process. While this somewhat alleviates the pressure gradients that result from substrate misalignment, it does not effectively eliminate them. Where the pad has deformed to accommodate any substrate misalignment, it has stored energy according to Hooke's law of elasticity, and therefor reacts with a higher force localized to the area of deformation.

Other devices endeavor to ensure proper alignment of the substrate to the abrasive head by providing a mounting structure for the substrate carrier that is capable of allowing the substrate carrier and platen to pivot to varying angles of tilt while simultaneously transmitting the downward force required for polishing. One such device is found in U.S. Pat. No. 4,270,314 to Cesna which discloses a mounting structure between the pressure plate and the supporting shaft that includes a bearing means suited both for allowing free rotation of the pressure plate relative to the supporting shaft (at varying angles of tilt) and for transmitting axial loads. Another such device is disclosed in U.S. Pat. No. 5,377,451 to Leoni et al. In Leoni '451 a pressure plate is connected by a universal joint assembly which permits rotation about the pressure plate axis and permits universal pivoting motion about a pivot point on the pressure plate axis.

In the static mode, such devices as described above appear to allow the substrate surface to align with the abrasive pad or strip as pressure is applied by the substrate carrier. But during polishing misalignment may again occur as a result of the frictional forces involved. For example, in a self-aligning substrate carrier having a pivot point at a distance above the polishing surface, an unwanted moment is created as a result of the frictional force generated in the plane of the polishing surface during polishing. This moment disadvantageously causes the platen and substrate to rotate about the pivot point, thus forcing the leading edge more severely into the abrasive pad. As a result the leading edge experiences over polish, and if the substrate carrier is selected to traverse a polishing path over the abrasive pad that involves travel in a variety of directions, a ring of over polish will be formed around the perimeter of the substrate.

Such removal rate problems are often compounded by the interaction of the various factors that arise during polishing. For example, as the friction moment causes the leading edge to dig in and over polish, as just discussed, the non-linear frictional forces on the pad may induce dynamic waves in the pad material thus causing regions of differing pressure. At the same time, the polishing fluid may not be evenly distributed under the substrate thus causing some areas to have higher or lower removal rates.

Under these complex dynamics involved in the polishing of a substrate, the function and relation of the containment ring becomes very important. At a minimum, the containment ring must provide lateral support at the edge of the substrate to prevent the substrate from slipping out from underneath the substrate carrier during polishing. To varying degrees, a number of known devices have improved over the basic containment ring shown in FIG. 1.

One such containment ring may be found in U.S. Pat. No. 5,398,459 to Okumura et al. Okumura et al. generally discloses the use of a rigidly mounted containment ring that is larger than the diameter of the substrate in a polishing apparatus involving a rotating abrasive pad as well as a rotating substrate carrier. In Okumura et al., the rotation of the turntable (to which the abrasive pad is affixed) imparts a pressing force in a direction parallel to the upper surface of the turntable to the workpiece so that an outer periphery of the workpiece contacts an inner periphery of the retaining ring, and the rotation of the retaining ring imparts a rotational force to the workpiece so that the workpiece undergoes a planetary motion relative to the platen.

Another containment ring known in the art may be found in U.S. Pat. No. 5,423,558 to Koeth et al. which discloses a containment ring rigidly mounted to the platen or carrier. To reduce unwanted edge effects, Koeth et al. discloses the use of a gimbaling head and a perimeter cavity cut into the platen just inside of the containment ring apparently to alleviate polishing defects at the perimeter by allowing the substrate perimeter to deflect.

Other containment ring devices employ the ring to have an effect on the abrasive pad in front of the leading edge of the substrate. Such a containment ring is disclosed in U.S. Pat. No. 4,954,142 to Carr et al. The containment ring disclosed in Carr et al. involves a containment ring in the form of a pressure plate that is spring mounted to the platen base. The containment ring in Carr et al. functions to depress the abrasive pad around the substrate during polishing and consequently lessening the pressure exerted against the edges of the substrate by the abrasive pad.

A similar device may be found in U.S. Pat. No. 5,498,199 to Karlsrud et al. where there is disclosed a ring that has an adjustable height relative to the platen. The containment ring is rigidly threaded onto the platen and adjustment requires turning the ring by hand. By such adjustment the amount of abrasive pad depression may be controlled, but there is no provision for ring pressure independent of the platen, nor does it possess any structure capable of performing self-correction for unwanted frictional moments.

Still another type of containment ring device may be found in U.S. Pat. No. 5,335,453 to Baldy et al. Baldy et al. discloses a spring mounted containment ring having a break, in which the entire outer perimeter of the substrate is supported. The ring is not designed to contact the polishing pad material.

From the preceding discussion, it should be apparent that it would be desirable to have a containment ring that provides for a uniform removal rate during polishing. It would be desirable to have a containment ring that has the ability to self-correct for the effects of unwanted friction moments and other polishing errors. In addition, it would be highly desirable to have a containment ring that exerts a pressure independent of the platen and that is adjustable during the polishing operation. It would also be desirable to have a containment ring that allows polishing fluid to pass to the substrate.

SUMMARY OF THE INVENTION

This invention involves an improved containment ring for use in conjunction with a polishing apparatus for holding a substrate against an abrasive work surface during polishing. The polishing apparatus may have a platen having a support surface adapted to support the substrate and a containment ring flexibly mounted to the polishing apparatus. This flexible mount arrangement advantageously allows independent angular tilt relative to the circular support surface upon which the majority of the substrate is supported. The containment ring may be adapted to receive a downward pressure that is independent from that pressure which is supplied to the platen.

According to one embodiment, the containment ring is mounted to surround the platen and may comprise a lateral stop feature defining an enclosed region larger than the diameter of the substrate and a peripheral support surface adapted to support only a partial outer perimeter section of the back side of the substrate. The peripheral support surface may be constructed to be generally parallel with the platen, or in a preferred construction, at an angle to the platen. The lateral stop surface may be generally perpendicular to said platen, or more preferably, forms an angle of less than 90 degrees with said platen.

This construction of the stop surface provides the required lateral limit of substrate travel in response to polishing forces and because the enclosed region formed by the lateral stop surface is larger than the substrate diameter it allows the substrate to advantageously precess to average out certain localized defects. In addition, by including a peripheral support surface, this construction allows for greatly improved control of edge effects.

The containment ring may further include an annular surface designed to interfere with the abrasive work surface as the containment ring is urged towards the abrasive work surface. This construction of the present invention provides for the containment ring to advantageously smooth and depress the abrasive work surface ahead of the substrate during polishing, thus reducing certain edge effects.

In accordance with another aspect of the present invention, the containment ring includes a plurality of flow channels formed therein. These flow channels greatly improve the flow of abrasive polishing fluid to and from the substrate being polished.

In accordance with another aspect of the present invention, the containment ring may be constructed as an assembly of two independent ring members. A first ring member includes a peripheral support surface for supporting a perimeter section of the back surface of the substrate. A second ring member may include a lateral stop surface. The second ring member may additionally include an annular surface for interfering with said polishing media and flow channels as described above. The rings may be separately mounted to the main body of the substrate carrier such that each has independent tilt and may be supplied with independent pressures.

Alternatively, the first ring member may be flexibly mounted to the second ring member which is in turn mounted to the main body of the substrate carrier by a flexure ring. If pressure applicators are employed, the variable pressure application supplying pressure to the first ring is coupled to the flexure ring.

DETAILED DESCRIPTION OF THE INVENTION

Figure 1:
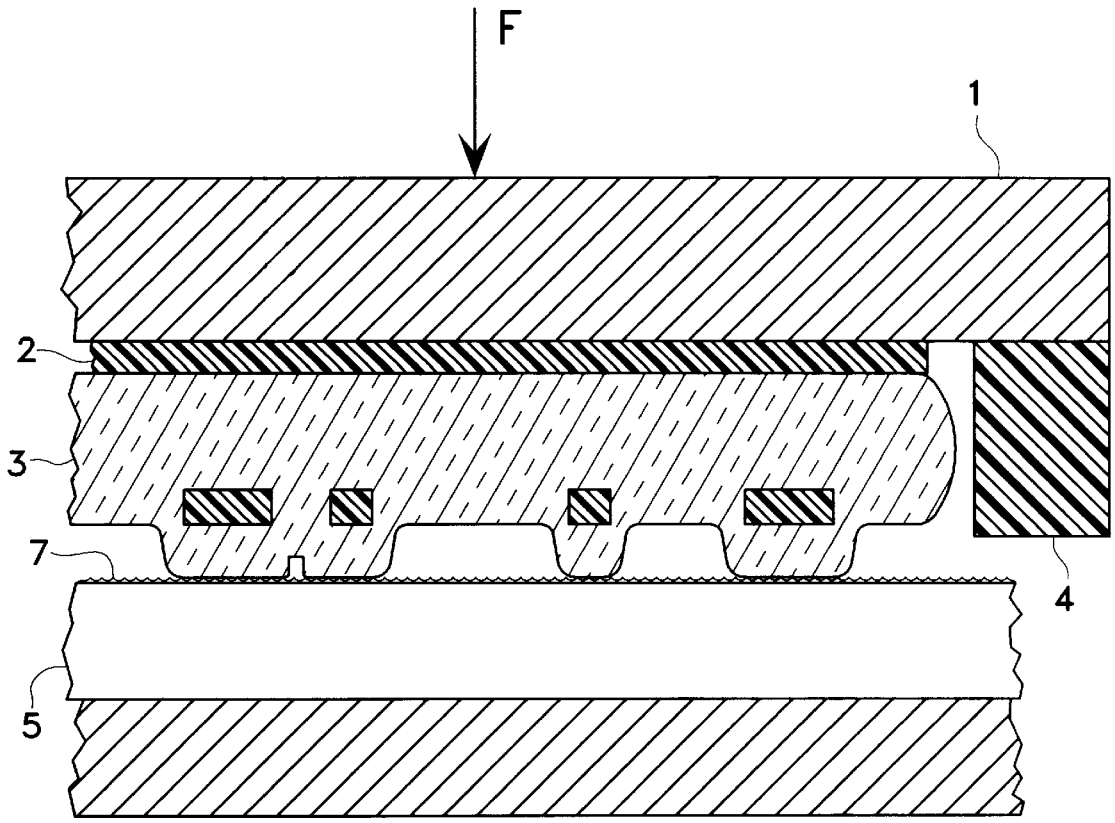
FIG. 1 (PRIOR ART)
FIG. 1, discussed above, is a cross-sectional view of the typical chemical mechanical polishing arrangement known in the art.

Referring to the drawings in detail wherein like numerals indicate like elements, the present invention generally involves a containment ring that may be used in conjunction with a substrate carrier, a polishing head, or other similar apparatus. The containment ring of the present invention advantageously self-corrects for certain non-uniform working pressures encountered during polishing. The containment ring may be configured to provide back surface support for only a portion of the substrate perimeter. The containment ring may be flexibly mounted to the substrate carrier and have an operating pressure independent of the carrier platen pressure. According to one aspect of the present invention, the containment ring may involve the use of polishing fluid channels for improved polishing fluid distribution.

A containment ring constructed according to the principle of the present invention may be used with any type of substrate carrier, substrate carrier apparatus or other polishing apparatus provided for forming a planar, mirror-like finish on a substrate. Preferably the substrate carrier is constructed to be self-aligning with the plane of the polishing media.

Figure 2:
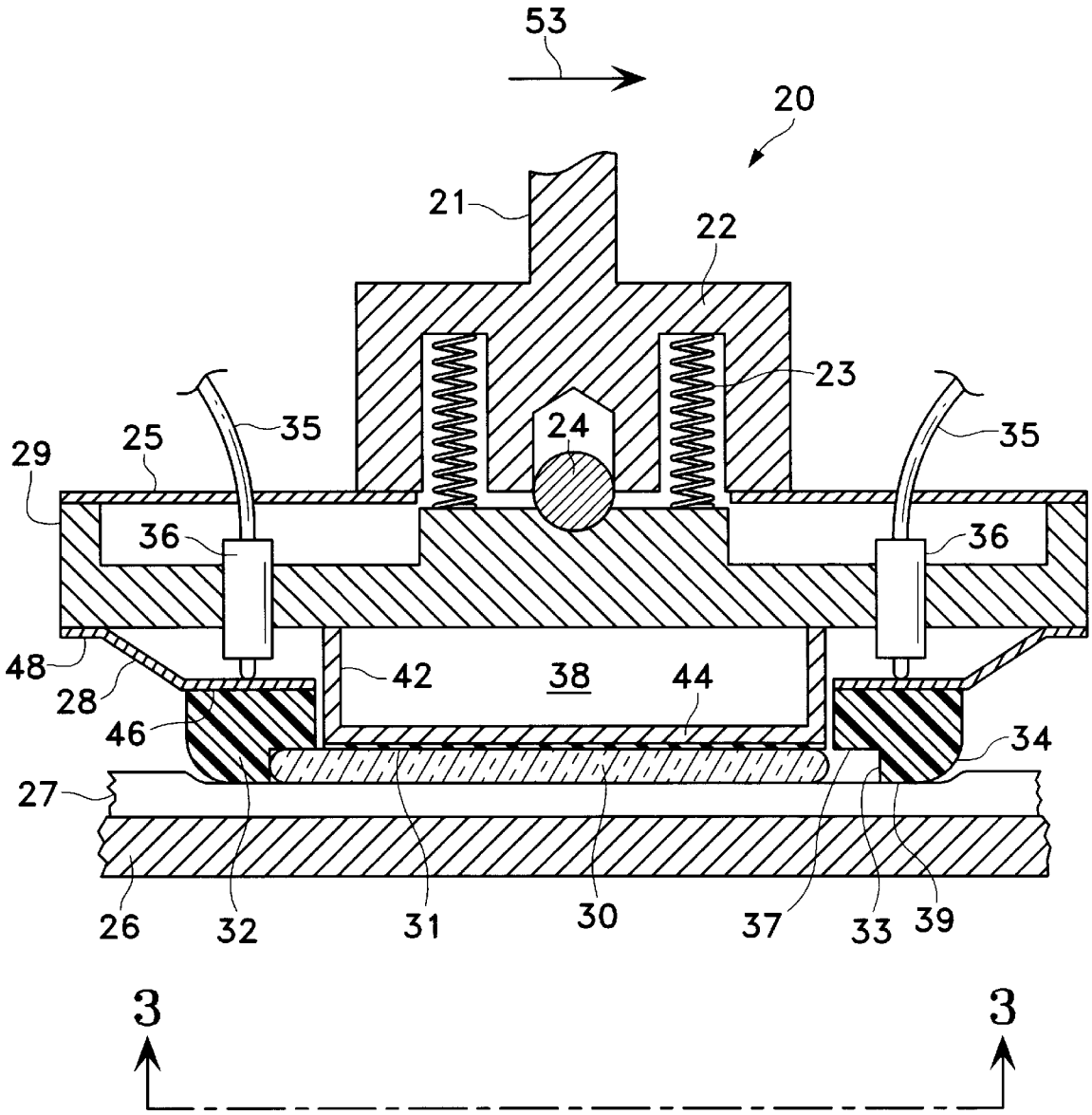
FIG. 2 is a cross-sectional view of a containment ring constructed according to the principles of the present invention.

FIG. 2 shows a containment ring 32 according to the principles of the present invention mounted to an illustrative substrate carrier 20. The front side of substrate 30 is shown held against polishing media 27 by operation of substrate carrier 20. Polishing media 27 is generally supported by support structure 26, which may be in the form of a rotatable disk (not shown) or in the form of a platform. Discussion of the various embodiments of the present invention will be in the context of a platform although the present invention is not intended to be so limited. Polishing media 27 is of any type common in the art and may be a single layer or a composite construction and may be a fixed abrasive material or constructed to be used with a polishing fluid.

Substrate carrier 20 may comprise upper shoulder assembly 22, to which main body assembly 29 is pivotably mounted by way of guide ball 24. Torque is transmitted from input shaft 21 to main body 29 by torque coupling 25. Torque coupling 25 is a thin ring shaped member that, by virtue of its geometry and composition, is sufficiently rigid to transfer torque from input shaft 21 and still flexible enough to allow main body 29 to gimbal about guideball 24. This gimballing or tilting motion of main body 29 advantageously allows substrate 30 to self-align with polishing media 27 as the working pressure necessary for polishing is applied to substrate carrier 20 through input shaft 21. Spring member 23, in conjunction with torque coupling 25, urges platen 44 back to its nominal, un-tilted position after polishing is complete and the working pressure is removed.

During polishing, substrate 30 is supported by substrate support platen 44. The outer surface of support platen 44 is adapted to support the back surface of substrate 30 and is designated as circular support surface 31. Circular support surface 31 may be constructed in any suitable manner and may include a thin layer of resilient material interposed between the substrate 30 and the support platen 44.

Substrate support platen 44 may be constructed to include a deformable sealed cavity 38. Substrate support platen 44 is connected to main body 29 by cylindrical sidewall 42 to form sealed cavity 38. Sealed cavity 38 may be pressurized, or subjected to vacuum, by a computer controlled pressure regulating device (not shown). The effect of any applied pressure or vacuum is to favorably deform substrate support platen 44 and consequently circular support surface 31 on which substrate 30 is supported.

Figure 3:
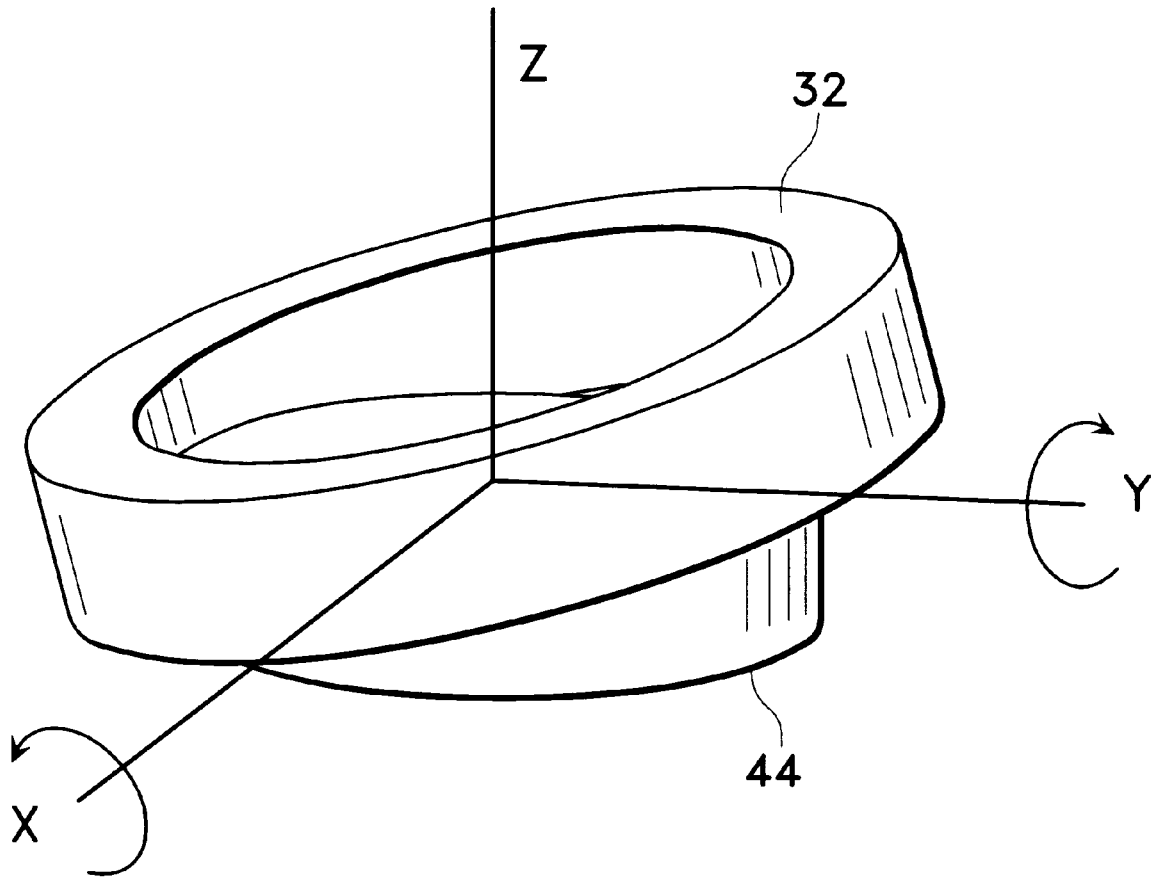
FIG. 3 is a diagrammatic illustration of the independent angular tilt of the containment ring of the substrate carrier relative to the platen of the substrate carrier.

Containment ring 32 is preferably connected to the substrate carrier in a manner that allows it to have independent angular tilt in relation to the substrate support platen 44 as shown in FIG. 3. In a preferred embodiment, containment ring 32 is flexibly mounted to main body 29 in a cantilevered fashion by flexure ring 28. Containment ring 32 is attached to a free edge 46 of flexure ring 28. The fixed edge 48 of flexure ring 28 is rigidly attached to main body 29. Mounting containment ring 32 on flexure ring 28 in this manner provides for the capability of independent angular tilt of containment ring 32 relative to main body 29 and, more particularly, to circular support surface 31.

Additionally, containment ring 32, because of its flexural mounting and capability of independent motion, may also act with a pressure independent of the pressure imparted to the main body 29 by input shaft 21. The amount of independent pressure exerted by the containment ring 32 may be controlled by applying a downward force which is independent of the force applied by the substrate carrier. This may be accomplished, for example, by proper selection of the spring rate of the flexure ring 28 or by using a number of linear force actuators which may be electric solenoids, hydraulic cylinders, linear stepper motors, or other such variable pressure application device.

FIG. 2 shows containment ring 32 constructed with a plurality of hydraulic cylinders 36 to provide real time adjustment of the independent pressure of the containment ring 32. Hydraulic connection 35 is connected to a computer controlled pressure regulator (not shown) for accurate control. Depending on the polishing pattern, a number of hydraulic cylinders will preferably be arranged around the diameter of the ring. Typically at least three hydraulic cylinders are equally spaced around the diameter, but any number and spacing that provides the necessary pressure control for the polishing pattern to be used is contemplated by this invention. In a preferred construction, six hydraulic cylinders are used.

Figure 4:
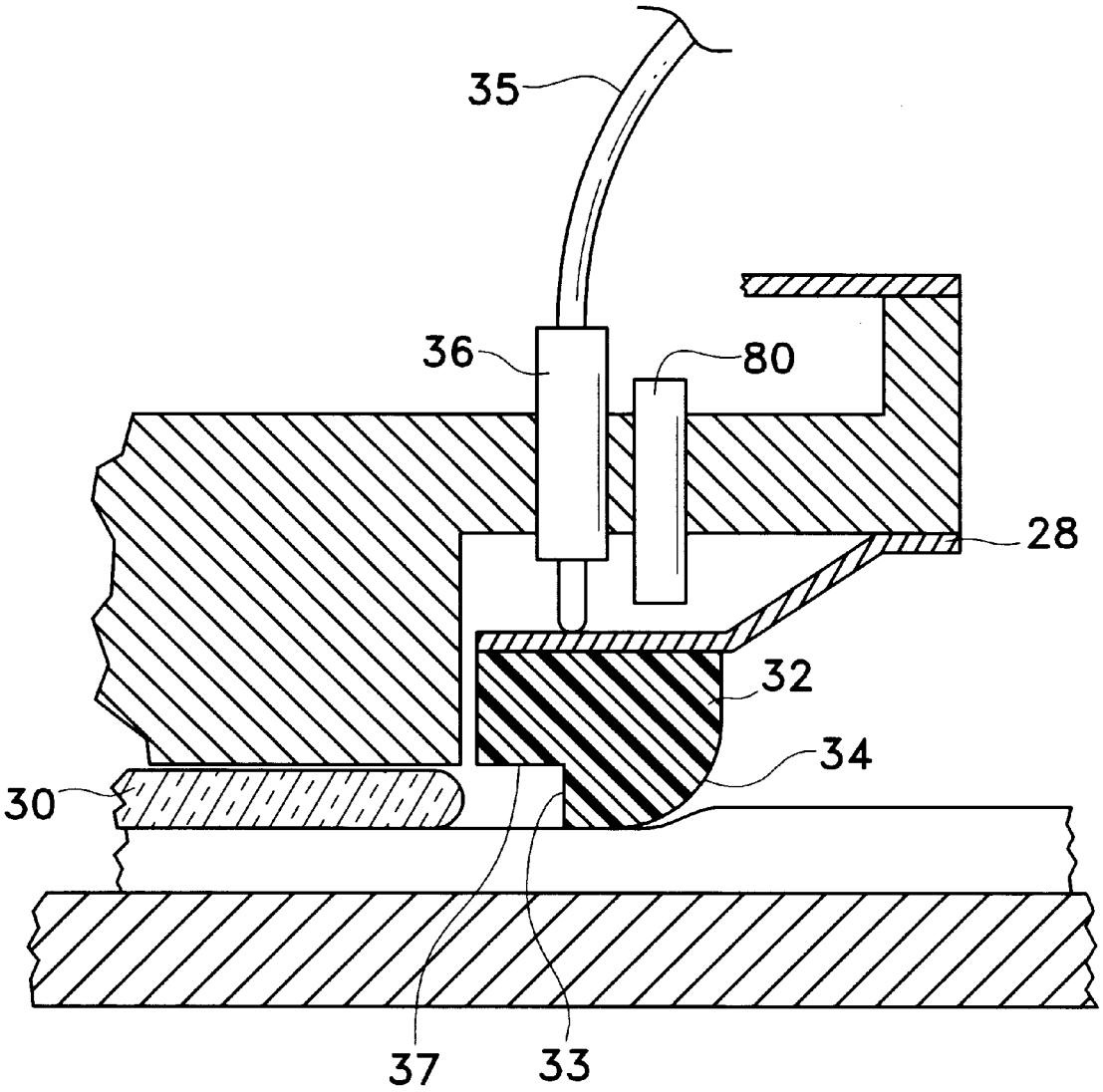
FIG. 4 is a partial cross-sectional view of an optional construction of the containment ring according the principles of the present invention.

When the containment ring 32 is constructed with the linear force actuators, containment ring 32 may also be constructed with a plurality of optional sensors 80, one of which is shown in FIG. 4. These sensors may be used to monitor the orientation of containment ring 32 relative to the substrate carrier. Containment ring orientation information from sensors 80 could be used in a control algorithm to dynamically adjust the force delivered by each of the hydraulic cylinders 36 to achieve optimum polishing. Any type of contact or non-contact sensor capable of determining the relative position of the containment ring would be suitable. For example, if the flexure ring 28 is metallic, an inductive proximity sensor mounted as shown in FIG. 4 would be capable of determining the distance to the metal flexure ring 28.

Containment ring 32 has several features that perform important functions in the polishing process. Containment ring 32 has a ledge shaped feature formed on the inside corner. The ledge shaped feature generally comprises a lateral stop feature 33 and a peripheral support surface 37. Lateral stop feature 33 defines an enclosed region that is larger than the diameter of the substrate. Peripheral support surface 37 is designed to support a portion of a perimeter section of the substrate 30. Containment ring 32 is generally made of a material having good dimensional stability, wear properties, and energy absorbing properties. In a preferred embodiment, containment ring 32 is made from POLY PHENKO ERTALYTE (PPE) or DELRIN, most preferably PPE.

Figure 5:
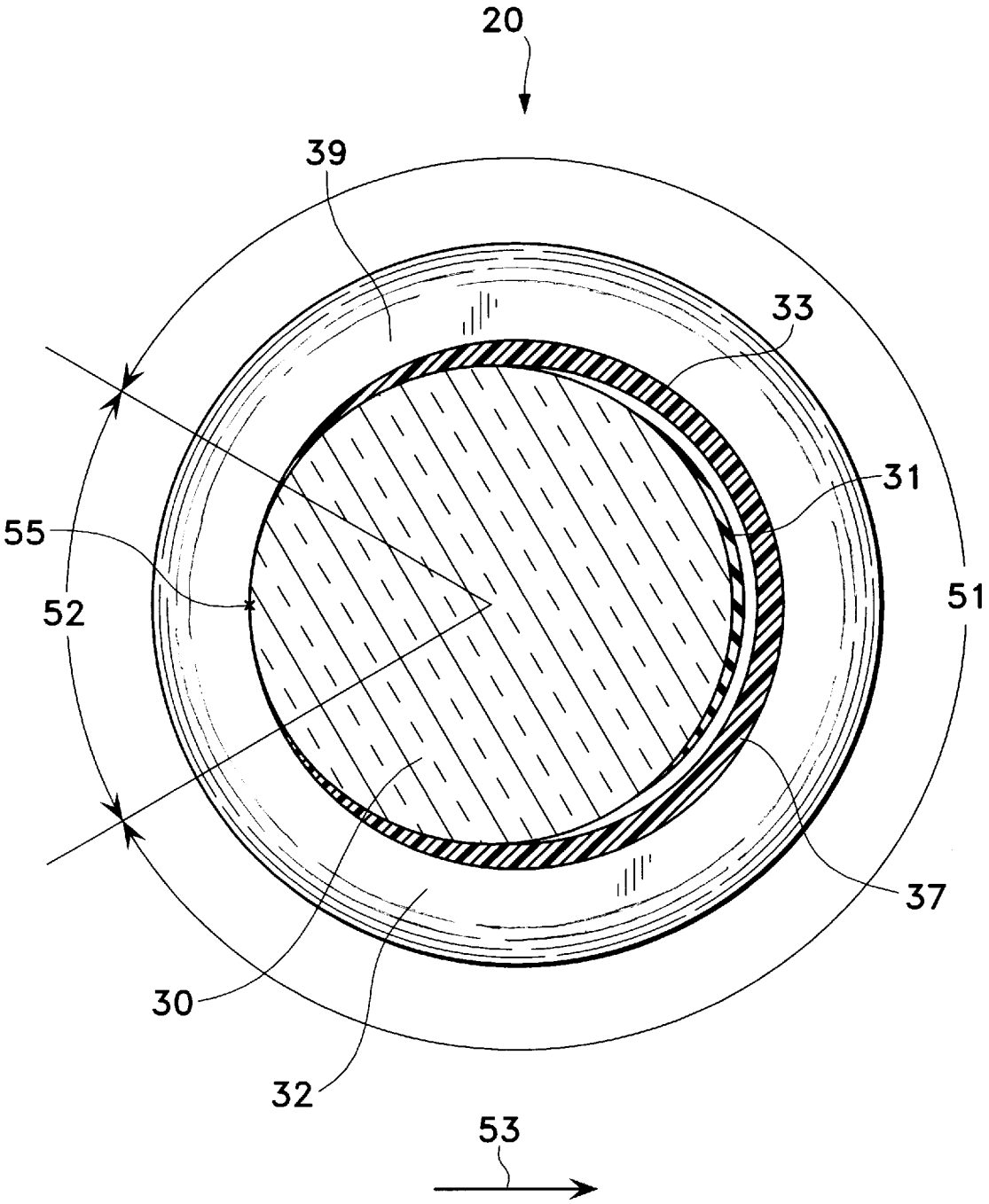
FIG. 5 is a bottom view of the substrate carrier in the direction shown by line 3—3 in FIG. 2 depicting visible portions of the various surfaces in cross-hatch form.

Referring now to FIG. 5, with the substrate 30 biased as shown to contact lateral stop feature 33 at contact point 55, it can be seen that peripheral support surface 37 offers support under the substrate 30 for only a portion of its perimeter section as shown with reference to supported portion 52. The remainder portion 51 of the perimeter of substrate 30 is unsupported by peripheral support ledge 37. The amount of the substrate's perimeter that is supported varies according to the relative diameters of circular support surface 31, lateral stop feature 33, and substrate 30.

In operation, the features described above operate to solve many of the polish defects inherent in prior art devices. FIG. 5 shows the position of the substrate 30 that would occur when the substrate carrier 20 is moved in the direction indicated by arrow 53. Assuming that the coefficient of friction is greater between the substrate 30 and the abrasive pad 27 than between the substrate 30 and the circular support surface 31, the substrate would generally slide in the direction opposite arrow 53 until it contacted lateral stop feature 33 at contact point 55. Thus, substrate 30 will always tend to orient itself against a contact point on the lateral stop feature opposite that of the direction of movement of the substrate carrier.

Depending on the polishing pattern used, substrate 30 will precess within the enclosed region bounded by lateral stop feature 33. Precession generally occurs as a result of changing the direction of polish as well by the polishing gradients inherent in the process. Such precession is desirable as the continuous substrate precession movement relative to the substrate carrier tends to spread the effects of a single point of over-polish or under-polish over a larger area of the substrate.

With substrate 30 biased against the lateral stop feature 33, peripheral support surface 37 engages only a portion of the substrate perimeter. As a result, pressure applied to the containment ring 32 is applied only to that section supported by the peripheral support surface 37 while the remaining perimeter section is unaffected by containment ring pressure.

This feature provides tremendous advantages. When a substrate is being polished, a frictional force is created in the plane of polish (essentially at the substrate surface). Since the pivot point of the substrate carrier is at a distance away from the plane of polish, an unwanted moment is created by the frictional force created during polishing. If substrate carrier 20 is moved laterally in a direction 53, the resulting friction force is created in the opposite direction to 53. This moment tends to make the substrate nose-dive and dig the leading edge of the substrate 30 into the abrasive pad 27 thus creating unwanted edge effects.

The containment ring constructed as described above has the ability to correct for this nose-dive condition. As the unwanted moment begins to urge the leading edge of substrate 30 into a nose-dive condition, it is immediately corrected by peripheral support surface 37 at the trailing edge of substrate 30. In contrast to containment rings which apply downward pressure to the entire perimeter of the substrate (leading edge and trailing edge), containment ring 32 of the present invention applies independent downward pressure to the trailing edge only, thus forcing the leading edge of substrate 30 out of the nose-dive condition.

Further, the supported portion 50 acts as a control region for the dynamics of polishing. That portion of the substrate 30 which is supported by the peripheral support surface 37, and is operating at a pressure independent of the support platen 44, operates as the control region from which the substrate is stabilized during polishing. At a given instant, an edge portion of substrate 30 tends to momentarily lock into that rather small, stable control region and the remainder of the substrate 30 is allowed to pivot about that point to equalize the dynamic variables of polishing (i.e., pressure gradients). Thus the control region acts as a hinge area for the substrate during polishing. There are several embodiments of the containment ring which provide for an optimized control region or hinge area for polishing.

Figure 6:
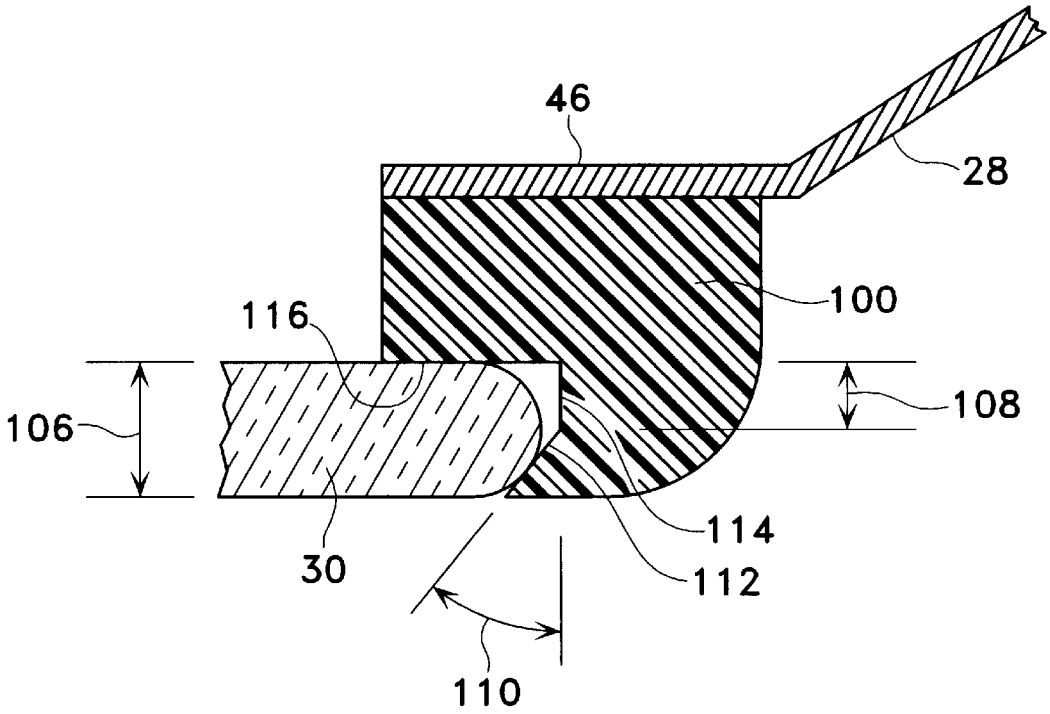
FIG. 6 is a partial cross-sectional view of an alternate embodiment of the containment ring according to the principles of the present invention.

FIG. 6 shows an alternate embodiment of the containment ring according to the present invention having features to improve the control region. Containment ring 100 is shown in partial cross-section mounted to free edge 46 of flexure ring 28 in the same manner as described above with reference to FIG. 2. Containment ring 100 has a ledge shape feature comprising a peripheral support surface 116 and a lateral stop feature having a first surface 114 and a second surface 112. The first surface 114 is generally perpendicular to the peripheral support surface 116 and has a depth dimension 108 of about one-half of the thickness of substrate 30. Second surface 112 extends from first surface 114 at an angle 110 as shown. The minimum value for angle 110 is generally between about 5 to 25 degrees and the maximum value is between about 45 to 65 degrees. Preferably angle 110 is between about 20 to 50 degrees, most preferably angle 110 is about 30 degrees.

In this containment ring configuration, the frictional force during polishing self-orients the edge of substrate 30 against the first surface 114 and second surface 112 (together operating as a lateral stop feature) at a location generally opposite to that of the direction of motion of the substrate carrier. As substrate 30 is urged into place during polishing, substrate 30 is forced upwards by forces resulting from the angle of second surface 112. Thus the portion of the substrate 30 that is supported by peripheral support surface 116 is more constrained, especially in the vertical direction.

Figure 7:
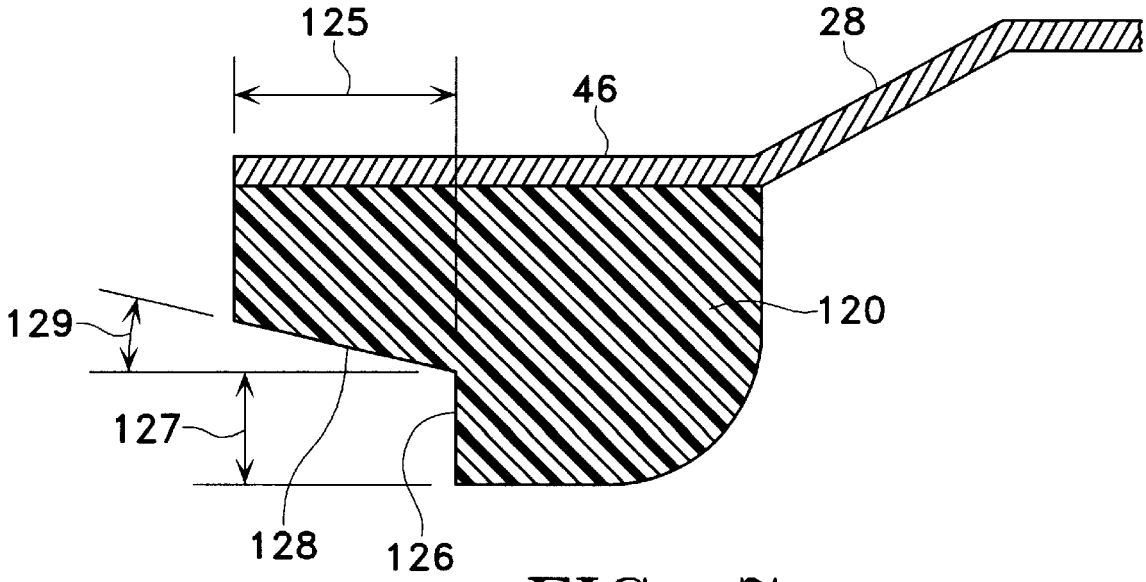
FIG. 7 is a partial cross-sectional view of a further embodiment of the inventive containment ring.

FIG. 7 shows a further embodiment of the containment ring according to the present invention. Containment ring 120 is attached to free edge 46 of flexure ring 28 and is provided with a lateral stop feature 126 and angled peripheral support surface 128. The depth dimension 127 is typically anywhere from 0.0 mm to about 0.3 mm greater than the thickness of the substrate to be polished. Preferably depth dimension 127 is about 0.075 mm greater than the thickness of the substrate. The width dimension 125 typically ranges from almost zero to about 10 mm. Preferably width dimension 125 is from about 2 mm to 5 mm, most preferably about 3 mm. The various other embodiments of the containment ring generally use the same dimensions as those just discussed with reference to FIG. 7.

In this embodiment, as the substrate is oriented against the lateral stop feature 126 by the polishing forces, the periphery of the substrate comes into contact with angled peripheral support surface 128 and it is forced downward towards the polishing media.

Angled peripheral support surface 128 generally forms angle 129 with the plane of polishing or the surface of the substrate. The minimum value for angle 129 is generally from about 1 to 25 degrees and the maximum value is between about 60 to almost 90 degrees. Preferably, angle 129 is between about 20 to 50 degrees, most preferably angle 129 is about 30 degrees.

One of the main advantages of this arrangement is that the amount of the substrate's periphery that is supported by the containment ring 120 is reduced to nearly a point contact due to the angularity of peripheral support surface 128. Thus the control area discussed above is effectively reduced to a control point from which the substrate can pivot more freely to equalize dynamic polishing variables. Whereas a larger supported area may be said to operate in a manner similar to a hinge, this type of point support by the containment ring may be said to operate similar to a ball joint having a greater number of degrees of freedom.

Figure 8:
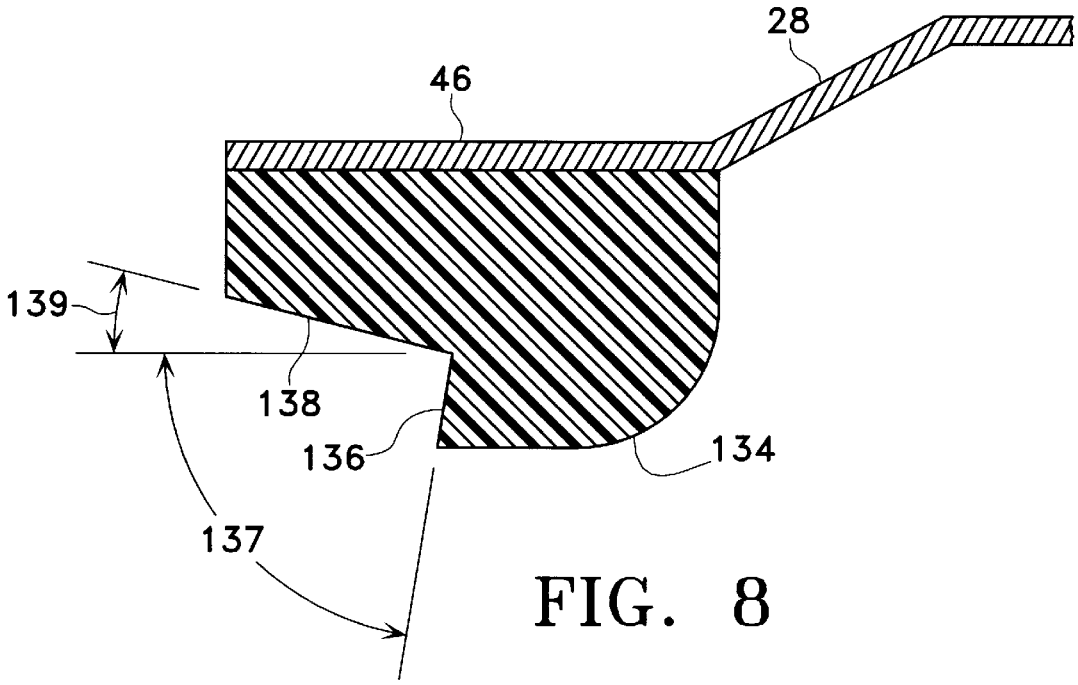
FIG. 8 is a partial cross-sectional view of another embodiment of the containment ring according to the principles of the present invention.

Still, it may be desirable to ensure that the substrate is adequately stabilized by the containment ring at the control point in the vertical direction. FIG. 8 shows another embodiment of the containment ring which includes a ledge feature that has both an angled peripheral support surface 138 and an angled lateral stop surface 136 to provide increased constraint in the vertical direction. More specifically, the substrate 30 is trapped by the angled surfaces at a known height relative to the annular contact surface 134. Peripheral support surface 138 and lateral stop surface 136 can be constructed to place the substrate at any relative position above or below annular contact surface 134. In a preferred embodiment, substrate 30 is trapped at a vertical location such that the substrate surface to be polished is recessed from the annular contact surface 134 by a small distance. As discussed above, a typical amount of recess may be from about 0.30 mm to almost 0.0 mm. Preferably, the recessed distance is about 0.075 mm.

Angled peripheral support surface 138 is at an angle 139 with the plane of polish. Angled lateral stop surface 136 has an angle 137 to the plane of polish. Angle 139 of the angled peripheral support surface generally has the same preferred angles as that discussed above with reference to FIG. 7. Angle 137 is preferably less than 90 degrees and greater than about 30 degrees. In a preferred embodiment, angle 137 is about 85 degrees.

With this construction, as the substrate is oriented into the ledge features of the containment ring by the polishing forces, the angled peripheral support surface 138 provides for an effective point contact while the angled lateral stop surface provides an upwards resultant force. With the substrate constrained in this fashion, independent pressure may be applied to the substrate at the control point and at the same time the substrate is allowed sufficient degrees of freedom to pivot in order to reduce pressure differentials during polishing.

Figure 9:
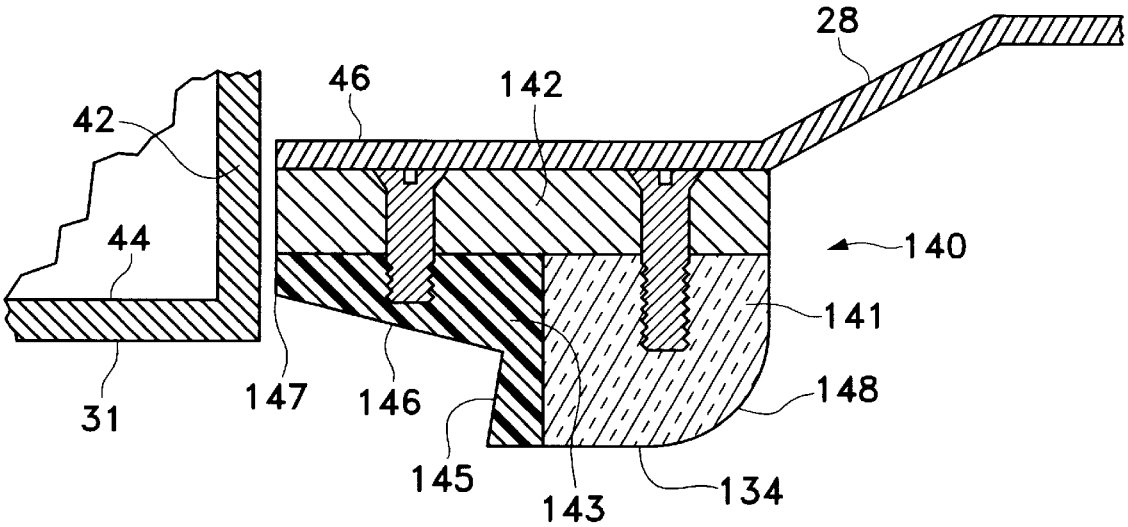
FIG. 9 is a partial cross-sectional view of an alternate construction of the containment ring.

A final advantage of embodiments employing an angled peripheral support surface is that it provides a better transition of the substrate edge as it crosses from the circular support surface 31 to the peripheral support surface 146, as illustrated in FIG. 9. The transition is better because the terminating point 147 of angled peripheral support surface 146 is recessed from the circular support surface 31.

In addition to the various ledge features described above, the containment ring of the present invention is also provided with a surface adapted to contact the polishing media ahead of the substrate as it is polished. Such a contact surface tends to smooth the polishing media and may reduce the amount of global deformation wave formation that tends to occur in the polishing media.

Deformation waves generally begin to form at whatever element is leading in the direction of movement and are dampened out in a relatively short distance. In this case, deformation waves are formed as the containment ring contacts the polishing media under pressure during polishing. These waves in the polishing media may cause an area of under-polish where the wave is low and an area of over-polish where the wave is high (i.e., at the peaks).

Referring again to FIG. 2, containment ring 32 may be constructed with annular surface 39 adapted to interfere with the abrasive pad 27 as said containment ring 32 is urged towards abrasive pad 27 during polishing. This alleviates adverse effects caused by global deformation wave formation in the polishing media because the waves form at the leading edge of containment ring 32 instead of at the leading edge of substrate 30 and are dampened out before they reach substrate 30.

As the substrate carrier moves relative to the polishing media, an improved transition may be accomplished by way of radiused surface 34 which extends from annular surface 39 to the outermost diameter of containment ring 32. Radial surface 34 provides a smoother interaction with the abrasive pad 27 at the leading edge of containment ring 32.

With this improved transition and the fact that the annular surface 39 is always pushed across the pad a distance ahead of the leading edge of the substrate 30, much of the negative effects of global deformation wave formation in the polishing media is eliminated. Although this feature of the present invention has been described with reference to the containment ring of FIG. 2, it applies equally to all of the containment ring embodiments discussed above.

Because the annular contact surface (i.e., annular surface 39) is always in contact with the polishing media, it may experience a great deal of wear. One way to deal with the wear problem is to provide a replaceable wear component on the containment ring as shown in FIG. 9. Containment ring 140 is constructed from several components, each may be selected to have the appropriate material properties.

Ledge feature component 143, generally comprises an angled peripheral support surface 146 and an angled lateral stop surface 145 as discussed at length above. The material for this component may be selected to provide desirable machining properties and to provide the appropriate tolerances for the critical ledge features. More importantly, ledge feature component 143 should be constructed from a material that has good shock absorbing properties. Preferably the material is PPE or DELRIN, most preferably PPE.

A separate wear component 141 generally includes annular contact surface 143 and radiused surface 148. Wear component 141 is replaceable as required and can be made from any material that has sufficient wear properties. In addition, since the material that is abraded away from wear component 141 may come into contact with the substrate, it is important that the material also be selected so as not to be reactive with the substrate during polishing. Preferably, wear component 141 is made from glass.

Both ledge feature component 143 and wear component 141 may be mounted to a rigid substrate component 142 as shown or mounted directly to free edge 46 of flexure ring 28.

Figure 10:
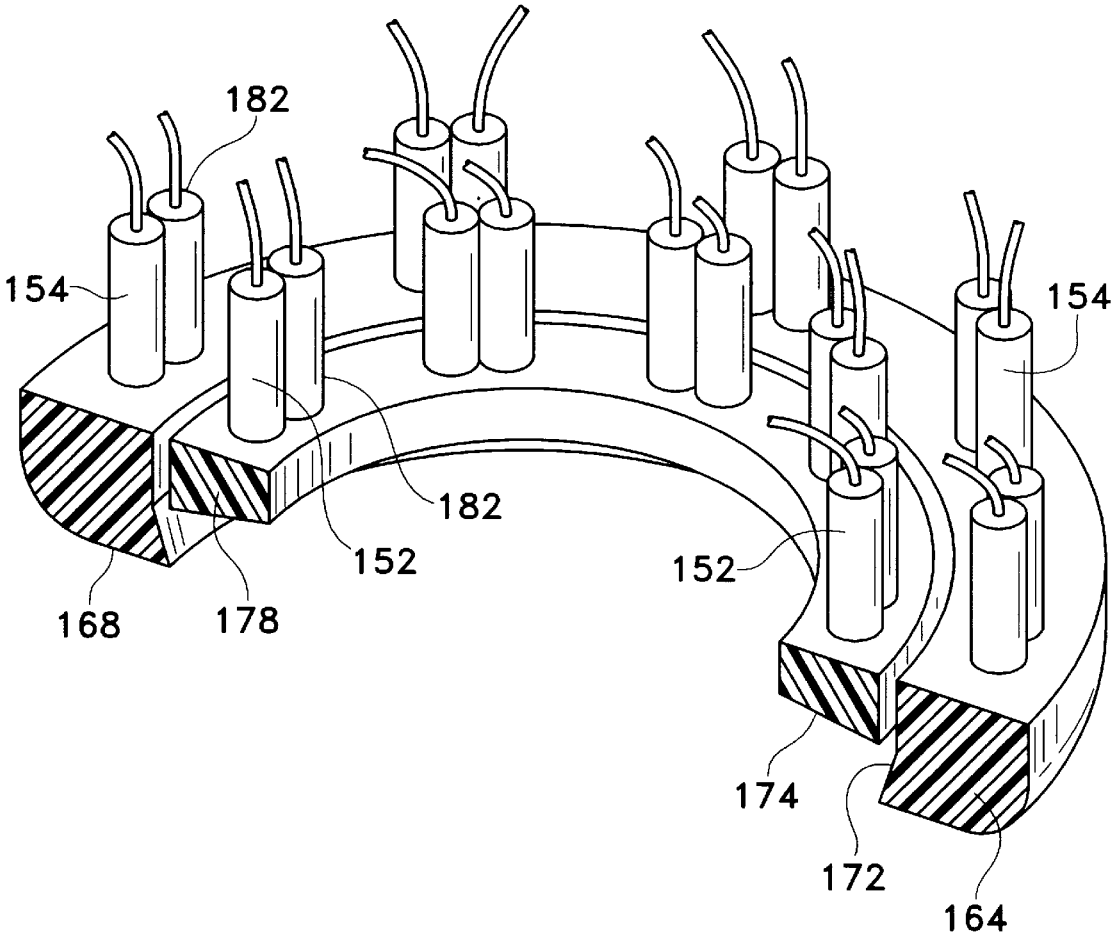
FIG. 10 is a partial perspective view of a split containment ring embodiment.

Another way to alleviate any potential wear problem with the surface that contacts the polishing pad is shown in FIG. 10. FIG. 10 shows a partial perspective view of a split containment ring embodiment according to the principles of the present invention. The split containment ring generally allows for independent or differential pressure control on the substrate periphery as discussed above but also allows for independent pressure on that portion of the containment ring that is in contact with the polishing media during polishing operations.

The split containment ring assembly generally comprises first ring 178 and second ring 164. First ring 178 has an angled peripheral support surface 174. A plurality of linear force actuators 152 provide the required independent vertical force on first ring 178. Second ring 164 has lateral stop surface 172, as well as annular contact surface 168. A plurality of linear force actuators 154 provide independent loading to the second ring.

In one embodiment, proximity sensors 182 may be associated with each linear force actuator (152 and 154) to provide information relating to the position and orientation of each ring. With this arrangement, each ring (164 and 178) may have its orientation monitored and independent pressures delivered. The result is delivery of the ideal pressure at the control area or control point on the substrate periphery and the ideal pressure at the annular contact surface 168 so as to reduce global wave formation. The wear on annular contact surface 168 may be reduced because with this split configuration a much lower pressure may be delivered to the second ring 164.

First ring 178 and second ring 164 are preferably flexibly mounted to allow for independent angular tilting motion as described above. The rings may be mounted in a number of ways. For example, the two rings may be independently mounted to the main body 29 as shown in FIG. 11 or first ring 178 may be flexibly mounted to second ring 164 which is in turn flexibly mounted to main body 29 as shown in FIG. 12.

Figure 11:
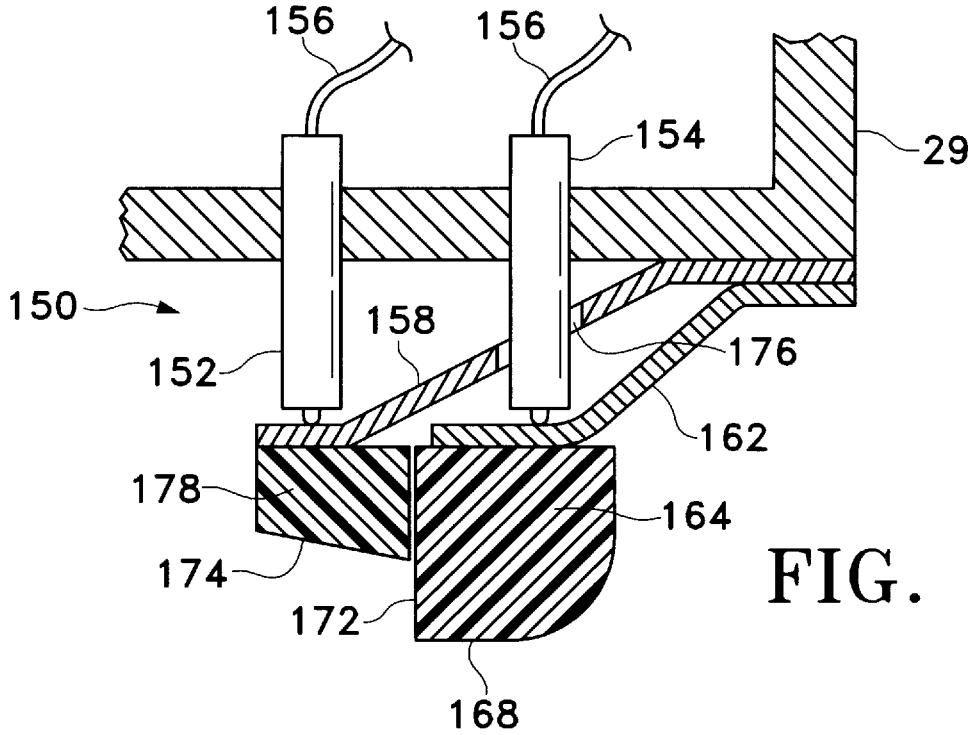
FIG. 11 is a partial cross-sectional view illustrating one type of mounting for the split containment ring of FIG. 10.

FIG. 11 shows split ring assembly 150 in a partial cross-sectional view. Split ring assembly 150 has first ring 178 mounted directly to main body 29 by way of first flexure ring 158 and second ring 164 mounted directly to main body 29 by way of second flexure ring 162. Flexure ring 158 has clearance holes 176 through which hydraulic cylinder 154 passes without contact. Hydraulic cylinders 152 and 154 are also fixedly mounted directly to main body 29 and supplied with pressurized fluid by way of hydraulic connections 156. Thus, referenced to main body 29, first ring 178 and second ring 164 may each be supplied with an independent pressure. With this construction, peripheral support surface 174 can exert a pressure on the wafer independent of the pressure exerted by annular contact surface 168.

Figure 12:
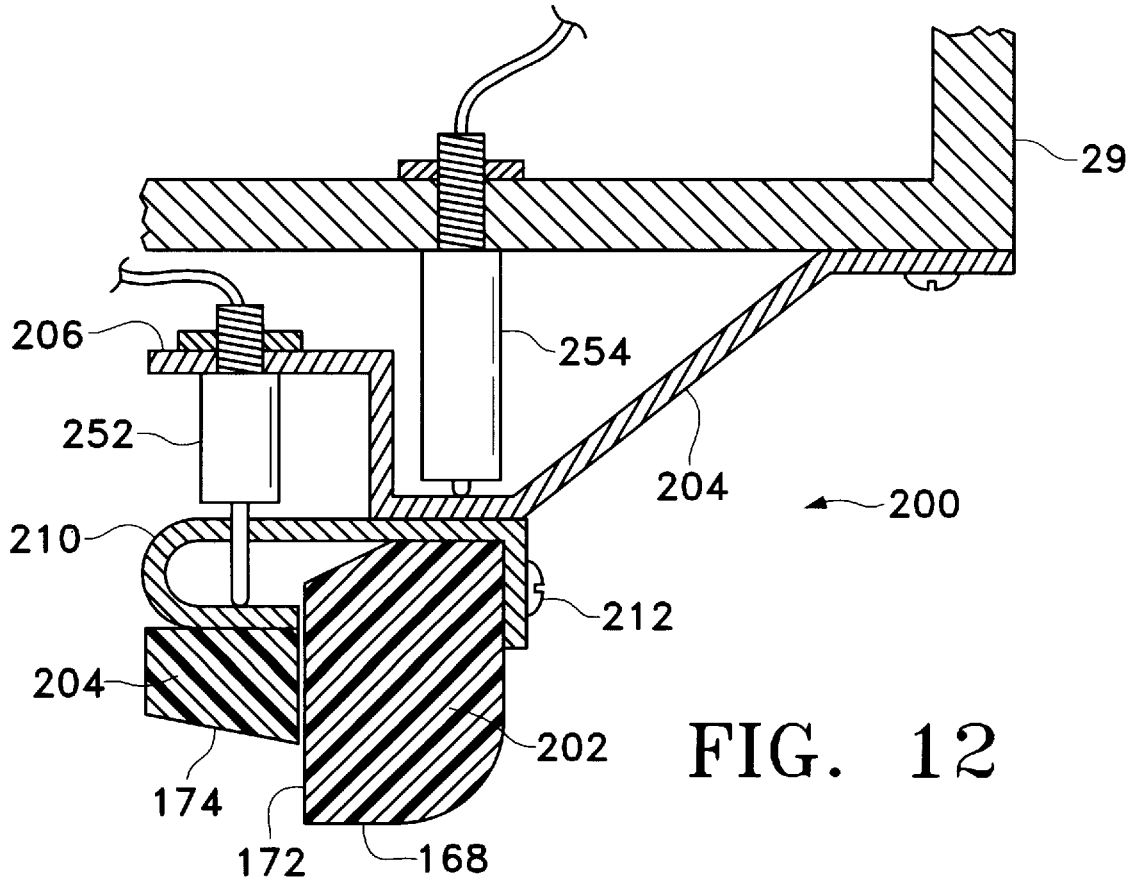
FIG. 12 is a partial cross-sectional view illustrating an alternate type of mounting for the split containment ring of FIG. 10.

An alternate mounting arrangement for a split ring embodiment is shown in partial cross-section in FIG. 12. Split ring assembly 200 again has first ring 204 with associated peripheral support surface 174 and second ring 202 with associated lateral stop surface 172 and annular contact surface 168. Second ring 202 is attached to main body 29 by way of flexure ring 204 and is supplied with independent pressure from a plurality of hydraulic cylinders coupled directly to main body 29, one of which is shown as hydraulic cylinder 254.

In this construction, first ring 204 is flexibly mounted to the second ring 202 by way of flexure member 210. Flexure member 210 may be attached to the outside of second ring 202 at screw location 212 as shown. Flexure ring 204 is further constructed to have a mounting flange 206 to which first ring hydraulic cylinder 252 may be attached. First ring hydraulic cylinder 252 supplies a pressure to first ring 204 that is referenced to second ring 202. Thus, with main body 29 as a reference, first ring 204 has differential pressure to that of the second ring 202.

Figure 13:
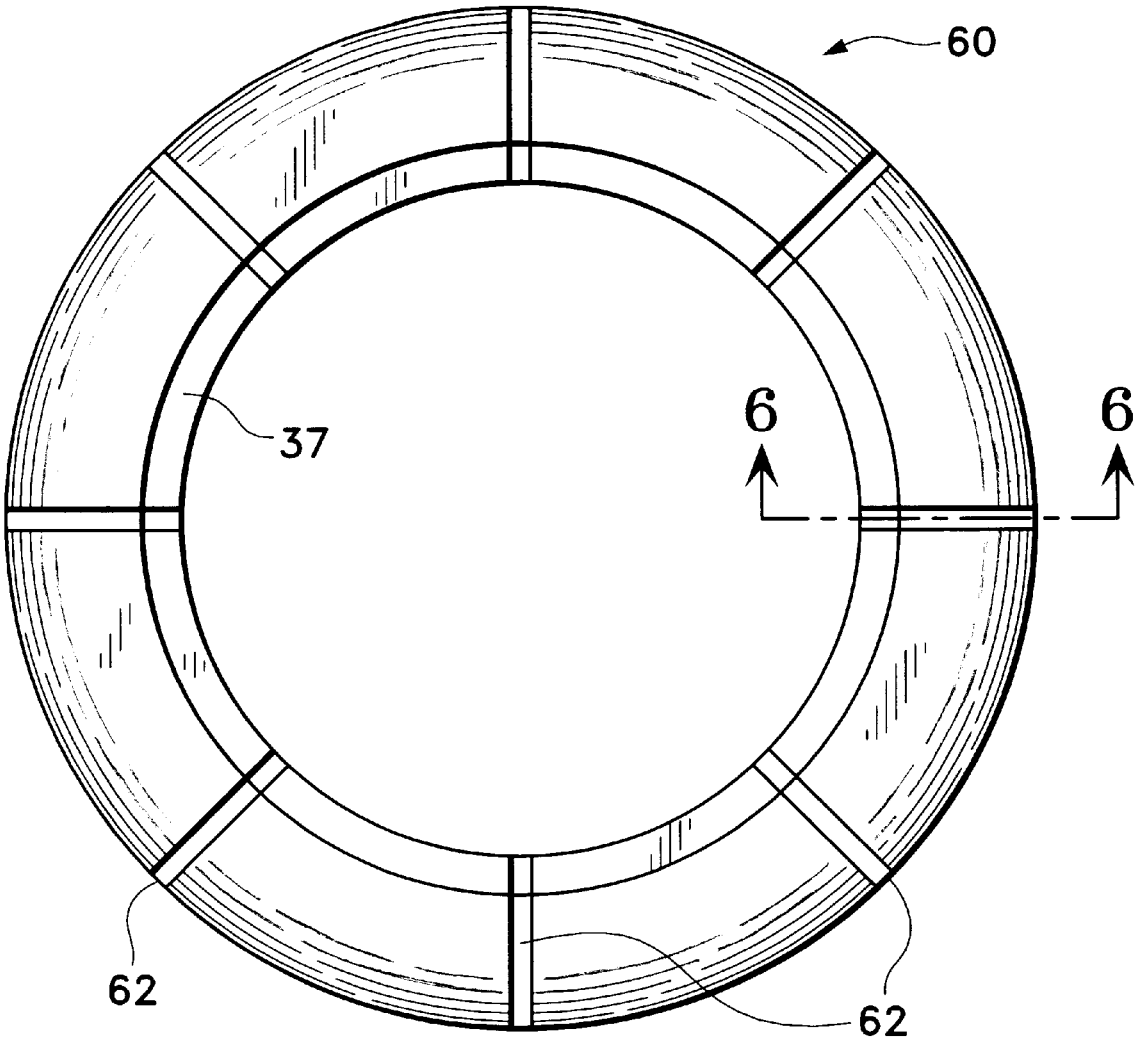
FIG. 13 is a bottom view of a containment ring having optional flow channels.
Figure 14:
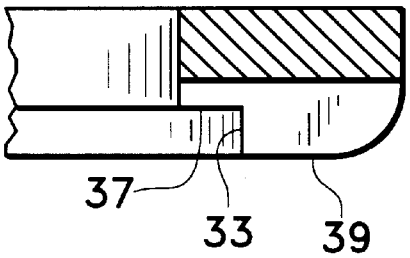
FIG. 14 is a cross-sectional view of the containment ring of FIG. 13 taken through line 6—6.

Still further, a feature of the containment ring deals with the tendency of the annular contact surface to adversely effect the flow of polishing fluid to the substrate during polishing. As illustrated in FIGS. 13 and 14, the containment ring of the present invention may be constructed with polishing fluid channels to facilitate polishing fluid delivery to the substrate surface during polishing. FIG. 13 shows a containment ring 60 having a plurality of flow channels 62 formed therein. Flow channels 62, as shown in cross-sectional FIG. 13, allow the abrasive polishing fluid to access and egress the substrate during polishing even though annular contact surfaces 62 remain in substantial contact with the polishing media.

The features of the substrate carrier described above that deal with the specifics of a given polishing process are not for the purposes of limitation of the present invention, but instead for the purposes of illustration and example. It is intended that this application include those modifications that would be apparent to one of ordinary skill in the art upon reading this description of the present invention. Accordingly, the scope of the present invention may be ascertained only by reference to the appended claims.

We claim:

1. A polishing apparatus for holding a substrate aligned against an abrasive work surface during a polishing operation, said substrate having a front surface to be polished and a back surface, said polishing apparatus comprising:

a.) a platen member having a support surface adapted to support a portion of the back surface of said substrate; and b.) a containment ring surrounding said support surface, said containment ring having;

i.) a lateral stop surface defining a region having a projected area greater than a surface area of the back surface of the substrate; and ii.) a peripheral support surface outlying said support surface of said platen member adapted to support an outer perimeter section of the back surface when the substrate is biased to contact said lateral stop surface, wherein the outer perimeter section is less than the entire perimeter of said substrate.

2. The polishing apparatus according to claim 1, wherein said peripheral support surface is substantially parallel with said support surface.

3. The polishing apparatus according to claim 1, wherein said peripheral support surface is at an angle to said support surface.

4. The polishing apparatus according to claim 3, wherein said angle is greater than about 5 degrees.

5. The polishing apparatus according to claim 1, wherein said lateral stop surface is substantially perpendicular to said support surface.

6. The polishing apparatus according to claim 5, wherein the angle between said support surface and said lateral stop surface is less than 90 degrees.

7. The polishing apparatus according to claim 1, wherein said containment ring is capable of independent angular tilt relative to said support surface.

8. The polishing apparatus according to claim 7, wherein said containment ring is adapted to receive a downward pressure that is independent from that which is applied to said platen member.

9. The polishing apparatus according to claim 1, wherein said containment ring further comprises an annular surface adapted to interface with said abrasive work surface.

10. The polishing apparatus according to claim 9, wherein said containment ring comprises a radiused surface connecting said annular surface to an outside diameter surface of said containment ring.

11. The polishing apparatus according to claim 1, further comprising variable pressure applicators which are controllable for real time adjustment of pressure applied to said containment ring.

12. The polishing apparatus according to claim 1, wherein said pressure is independent of any pressure applied to said platen member.

13. The polishing apparatus according to claim 1, further comprising at least one sensor to determine the relative position of a said containment ring.

14. The polishing apparatus according to claim 1 wherein said peripheral support surface is angled and said lateral stop surface is angled and further comprising an annular surface adapted to interfere with said abrasive work surface, such that an edge location on said substrate is constrained at a predetermined vertical position relative to said annular contact surface.

15. The polishing apparatus according to claim 14, wherein said predetermined vertical position places said back surface of said substrate a distance above said annular contact surface.

16. The polishing apparatus according to claim 1, wherein said peripheral support surface and said lateral stop surface are moveable relative to each other.

17. The polishing apparatus according to claim 16, wherein said peripheral support surface and said lateral stop surface are actuated by forcing elements.

18. The polishing apparatus of claim 17 wherein said containment ring further comprises a wear component.

19. The polishing apparatus of claim 16 wherein said containment ring further comprises a wear component.

20. The polishing apparatus of claim 1 wherein said containment ring further comprises a wear component.

21. A ring assembly for containing a substrate during polishing, the substrate having a substantially planar surface, said ring assembly comprising a first ring member having a first surface for supporting at least a portion of the back surface of the substrate and a second ring member having a second surface which forms a substantially enclosed region to which movement of said substrate is limited.

22. The ring assembly of claim 21 wherein said first ring member and said second ring member are flexibly mounted independently of each other.

23. The ring assembly of claim 21 wherein said first ring member is flexibly mounted to said second ring member.

24. The ring assembly of claim 21 further comprising a plurality of first variable pressure applicators acting upon said first ring and a plurality of second variable pressure applicators acting upon said second ring, said pressure applicators being controllable for real time adjustment of pressure applied to each ring.

25. The ring assembly of claim 24 further comprising at least one sensor associated with said first ring and at least one sensor associated with said second ring, whereby the relative positions of said first ring and said second ring may be determined and used as feedback for real time control of the pressure applied to each said separate first and second ring.

26. The ring assembly according to claim 21 wherein said second ring further comprises a wear component.

27. The ring assembly according to claim 26 wherein at least a portion of one of said first and said second surfaces is non-orthogonal with respect to the surface of the substrate during polishing.

28. The ring assembly according to claim 21 wherein at least a portion of one of said first and said second surfaces is non-orthogonal with respect to the surface of the substrate during polishing.

* * * * *